United States Patent [19]

Dion

[11] 4,427,194

[45] Jan. 24, 1984

[54] APPARATUS FOR USE IN ARM WRESTLING OR WRIST PULLING CONTESTS

[76] Inventor: Exsior Dion, 547 River Rd., Lincoln, R.I. 02865

[21] Appl. No.: 454,043

[22] Filed: Dec. 28, 1982

[51] Int. Cl.[3] ..... A63B 21/28; A63B 71/00

[52] U.S. Cl. ..... 273/1 GC; 272/134; 272/901; 273/1 GI

[58] Field of Search ..... 273/1 GI, 1 GC; 272/67, 272/DIG. 7, DIG. 8, 117, 118, 130, 132, 134, 128, 129, 136

[56] References Cited

U.S. PATENT DOCUMENTS

| | | | |
|---|---|---|---|
| 911,925 | 2/1909 | del Valle y Zeno | 272/67 X |
| 2,782,033 | 2/1957 | Ugartechea | 272/67 |
| 3,662,602 | 5/1972 | Weiss | 272/67 X |
| 3,735,983 | 5/1973 | Ortiz | 272/67 UX |
| 3,743,284 | 7/1973 | Rhodes et al. | 273/1 GI |
| 4,131,275 | 12/1978 | Gandy | 273/1 GI |
| 4,209,167 | 6/1980 | Jansen | 272/67 |
| 4,327,910 | 5/1982 | Mackie | 273/1 GI |

*Primary Examiner*—Paul E. Shapiro

*Attorney, Agent, or Firm*—Robert J. Doherty

[57] ABSTRACT

Apparatus for conducting arm wrestling (wrist pulling) contests between a pair of opposed contestants comprising a frame generally of semi-circular configuration and defining an upright plane in which a lever arm is adapted for pivotal side-to-side motion. The opposed contestants each grip a portion of the lever arm in an attempt to force such to one side of its travel limit defined by the frame and against the opponent's urging. The upper end or ends of the lever arm are positioned within an arcuately-shaped track defined by the frame and signal devices are provided which are in turn activated upon the contacting limit switches positioned at opposed sides of the frame.

8 Claims, 6 Drawing Figures

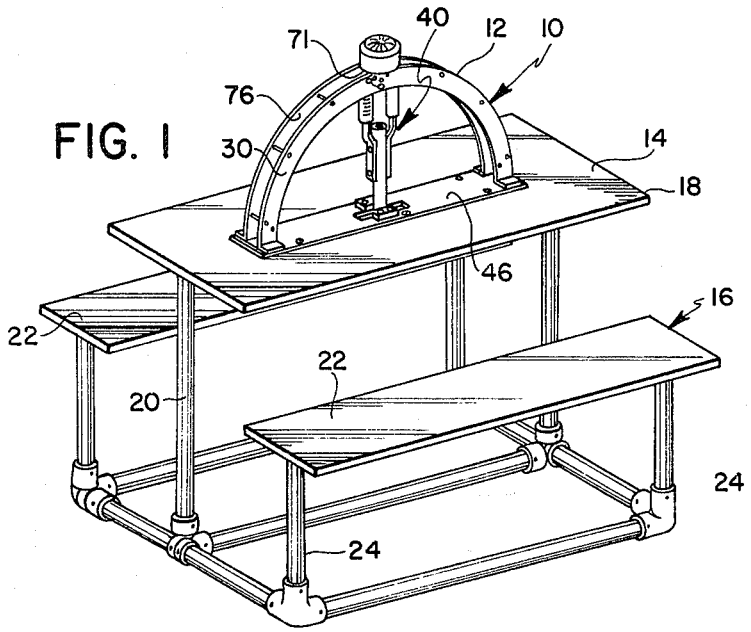
FIG. 1
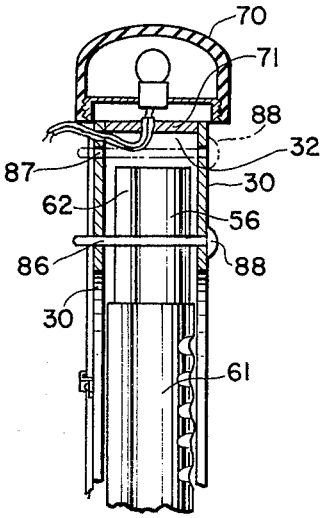
FIG.3
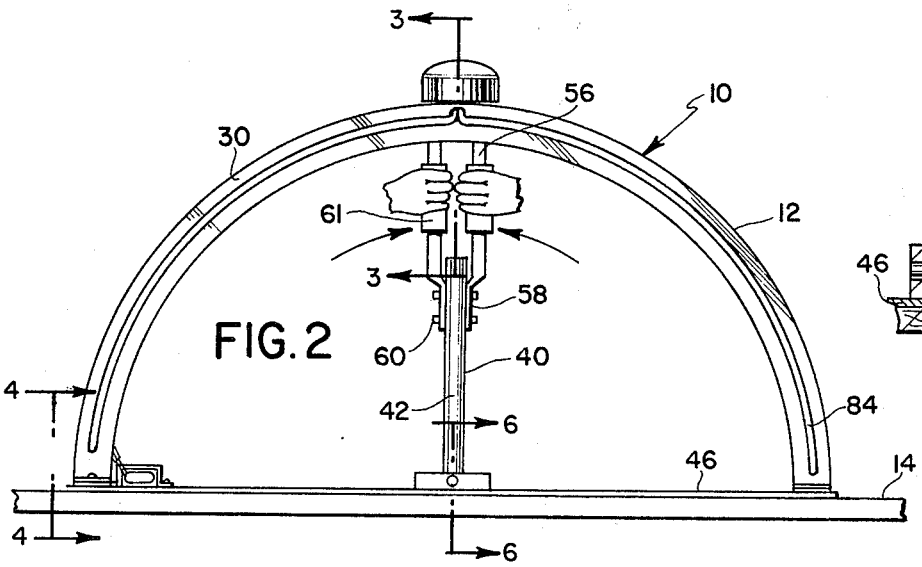
FIG.2
FIG. 6
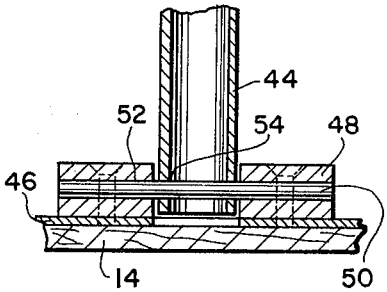
FIG. 4
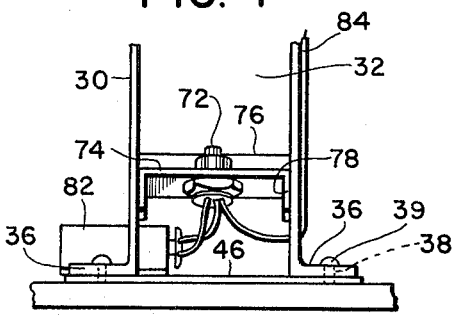
FIG. 5
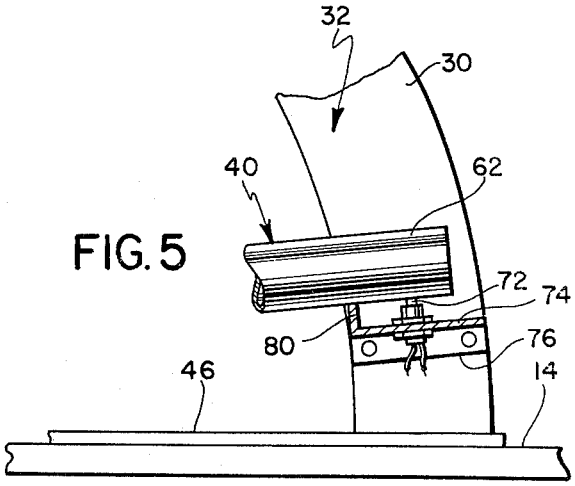

APPARATUS FOR USE IN ARM WRESTLING OR WRIST PULLING CONTESTS

BACKGROUND AND OBJECTS OF THE INVENTION

The present invention deals with a novel apparatus for conducting strength contests generally referred to as arm wrestling or wrist pulling and more particularly to such an apparatus wherein various techniques generally considered to be unfair are entirely or at least to a great extent eliminated. In such arm wrestling contest, the overall object is to grasp hands with an opponent and thereafter attempt to force his arm downwardly onto a contest surface such as a table or the like. In such contest the opponent's elbows should remain generally in place and the force applied such that the back and forth arm motion takes place in an upright plane generally normal to the contest surface. There are, however, several techniques for gaining an unfair advantage over an opponent including (1) instead of pushing the opponent's arm towards the down position, the opponent's hand is pulled away from him leaving his wrist and hand bent slightly backway thereby reducing his pushing power (this is known as "breaking the opponent's wrist"); (2) instead of pushing the opponent's arm towards the down position, his arm is pulled away from him leaving his arm outstretched accordingly reducing his pushing power; (3) instead of pushing the opponent's arm towards the down position, the opponent's arm is held in either of the positions described in 1 and 2 above (this action tires the opponent); (4) to reduce the opponent's power, body weight is utilized in conjunction with the techniques described in 1, 2, and 3 above; (5) the use of the non-pulling arm as a brace against any object either alone or when combined with techniques described in 1 to 4 above also helps to unfairly overcome an opponent; and (6) feet bracing by contacting one's feet in a bracing position to the floor or leg bracing to portions of the table or bench on which players are positioned is another technique either utilized alone or in conjunction with the techniques described in 1 through 4 above also adds strength to unfairly overcome an opponent.

It is, accordingly, the overall object of the present invention to present an apparatus which when utilized in such arm wrestling contest will eliminate or at least reduce the number of unfair advantages or tricks that one opponent can utilize against another so as to generally assist in the promotion of fairness in such contest. The above and other objects of the present invention are accomplished by the provision of an apparatus for conducting arm wrestling contests between a pair of opposed contestants comprising a frame having a pair of laterally spaced, arcuately-shaped members adapted for upright positioning on a contest surface and defining an arcuately-shaped track, an elongated lever arm having upper and lower ends, said lever arm pivotally supported at its lower end proximate said contest surface and engaged in said track at its upper end for side-to-side arcuate movement within the limits defined by said frame, said arm including a pair of laterally spaced hand grip portions positioned along the extent of said arm intermediate the ends thereof, signal means including activation means positioned on said frame at the opposite ends of said track for contact by said arm when moved to either of its side-to-side limits for activating said signal means.

Other objects, features and advantages of the invention shall become apparent as the description thereof proceeds when considered in connection with the accompanying illustrative drawing.

DESCRIPTION OF THE DRAWING

In the drawing which illustrates the best mode presently contemplated for carrying out the present invention:

FIG. 1 is a perspective view showing the manner in which the apparatus of the present invention may be mounted on a contest surface so as to enhance the fairness of arm wrestling contests.

FIG. 2 is an elevated view of the frame portion of the apparatus on an enlarged scale and shows the manner in which opponents may utilize the apparatus in the intended manner;

FIG. 3 is a sectional view taken along the line 3—3 of FIG. 2;

FIG. 4 is a partial end view on an enlarged scale taken along the line 4—4 of FIG. 2;

FIG. 5 is a side view of the frame portion shown in FIG. 4 and showing the manner in which the lever arm may be used to activate a signal means; and FIG. 6 is an enlarged sectional view taken along the line 6—6 of FIG. 2.

DESCRIPTION OF THE INVENTION

Turning now to the drawing and more particularly to FIGS. 1 and 2 thereof, the overall configuration of the device of the present invention is best shown. Such device or apparatus 10 includes a frame 12 of an overall arcuate and preferably semi-circular configuration. Such frame 12 may be utilized in conjunction with a contest surface 14 defined by the upper surface of a conventional table or may be utilized as shown in FIG. 1 with the combined bench and table 16 shown therein. As illustrated in FIG. 1, a contest surface 14 is formed by the upper surface of a relatively long table 18 supported at a higher than normal height by a supporting structure, i.e., the laterally opposed legs 20 shown. A pair of benches 22 also supported at a higher than normal height away from the floor, ground, etc. are positioned on opposite sides of the table 18 such that the contestants may sit on the benches in opposed facing positions to each other. In this manner the opponent's legs will not be able to touch the ground or the supporting legs 24 of the benches 22 by reason of their spacing will not be able to be contacted by the opponent's legs as well. The use of this novel table in conjunction with the apparatus 10 of the present invention eliminates the unfair advantages previously described as leg and foot bracing. It should be brought out, however, that the device 10 of the present invention has utility separate and apart from its above-described use in conjunction with the novel table and bench structure above defined.

Turning now to FIG. 2 of the drawing, the structure of the apparatus 10 is best shown. Therein a frame 12 is composed of a pair of laterally separated, longitudinally directed semi-circular members 30 formed from any suitable rigid material. The members 30 in cooperation form an arcuate channel or track 32 therebetween. As will hereinafter be more evident, push button brackets at the opposite ends and a light bracket at top center act as spacers to hold the rigid members 30 apart the desired width so as to give the proper clearance for the lever arm 40 to be moved to either side in the channel 32. The opposite ends of each member 30 include an outwardly flared or bent terminal flange 36 including openings 38 provided therethrough such that the frame may be conveniently attached as by bolts 39, screws, and the like to the contest surface such that the members 30 define an upright contest plane generally normal to the contest surface and in which a lever arm 40 is positioned for pivotal side-to-side movement within restraints as defined by the channel 32. In such lever arm 40 includes a central upright post 42 supported at its lower end 44 for pivotal movement in relationship with the contest surface. In a preferred form of the invention shown, the frame 12 includes a generally planar cross member 46 which forms a connecting base between the opposed ends of the frame. In this regard, the flanges 36 are adapted to be positioned over the ends of the base 46 and connected thereto by bolts or as by welding. Thereafter the bolts 39 may pass through aligned openings in the flange and base ends respectively so as to connect the device 10 to the playing surface by means of the bolts 39. The mid point of the base 46 includes a pair of upright trunnions 48 having aligned openings 52 to support a pin 50 which in turn passes through aligned openings 54 in the lower end 44 of the arm 42 and thus support such for pivotal back and forth motion within the contest plane.

The central portion of the lever arm 42 is provided with a pair of generally L-shaped members 56 having base portions 58 positioned in opposition to each other and provided with aligned openings (not shown) through which a connecting means such as bolts 60 may pass therethrough and through similar openings provided in the central portion of the post 42 so as to position the members 56 as shown. Such members 56 are further provided with hand grips 61 at the upper portions thereof and terminate in upper ends 62 which extend into the channel 32 formed by the laterally spaced plates 30 and in contact or at least approximating contact with the inside surfaces of such plates 30. In this manner then the grips 61 may be gripped by the hands of the opposed players while each such contestant attempts to force the lever to the left or right hand limit against the opposing action of the other contestant.

A signal 70 in the form of a light and/or buzzer or any combination thereof is mounted preferably at the top of the frame within plain view of both contestants. The signal 70 may be mounted on a bracket 71 which extends between members 30 and acts as a spacer. The manner of activating such light, buzzer, or other signal 70 is my means of a depressible switch 72 mounted on the central portion 74 of a U-shaped combination lever arm stop and frame member spacing device 76. Spacers (not shown) apart from bracket 71 and members 76 may be also used to space the members 30, i.e., U-shaped brackets positioned between the sides and the top thereof. Such spacing member 76 includes a pair of laterally spaced flanges 78 downwardly dependent from the central connecting member 74 on which the switch 72 is mounted and an upright flange projecting from the front portion of such connecting member 74. The upright front portion 80 forms a stop against which the lever arm 40 is adapted to contact momentarily after depressing the contact switch 72 enough to activate a signal circuit powered by a battery 82 or other source of power and connected to the signal 70 by means of wires 84 positioned along one of the outside surfaces of one of the members 30 and held in place by any convenient means such as snaps, tape, and the like (not shown).

Thus when one contestant is able against the force of his opponent to force the upper part 62 of a lever arm 40 such that it contacts the switch, the signal will be activated in a clear and positive fashion which removes the doubt as to which contestant won that heat, contest, and the like. It should also be brought out that the device 10 of the present invention by forcing the contestants to operate within the confines of the contest plane, that is, by applying their force directly to the independent grips 61 and by applying pressure in opposite directions essentially solely in such plane, that the tricks and techniques often utilized by one contestant against another to unfairly gain an advantage thereover are eliminated. Thus one contestant cannot "break the wrists" of the other contestant nor can he force the other contestant's arm towards him or hold the contestant's arm in either of these positions. In addition, the uncertainties brought about by the direct hand grasping of the opponents is also eliminated.

Inasmuch as the lever 40 is normally unsupported and, accordingly, would normally fall to one or the other side of its limit as defined by the frame 12, it is desirable to provide for the upright positioning thereof when not utilized in a contest such that neither of the limit switches 72 will be activated and undesirably run down the power source 82 or continually sound or light the alarm 70. To provide for such upright positioning, the uppermost portion of the spaced members 30 are provided with a pair of aligned holes 86 and 87 through which a pin 88 may be positioned. When the pin 88 is placed into the aligned holes 86 of the spaced members 30, the pin 88 is positioned to be between the upper portions of members 56, thus allowing these members 56 to tilt a little side to side but not enough tilt to allow members 56 to come in contact with switch button 72. In this position the apparatus is held in a non-use or hold attitude. When the pin 88 is placed into the aligned holes 87 of the spaced members 30, the pin 88 is above the members 56 thus allowing these members 56 to travel fully to either side to come in contact with switch buttons 72 to declare a winner. In this position the apparatus can be used for contests in the intended manner. When it is desired to engage in a contest, the opponents can initially secure their grasp on the grips 61 and begin to apply an even pressure in opposite directions and thereafter the pin 88 removed to signal the initiation of the contest. The pin may then conveniently be placed in the upper aligned holes 87 so as to not interfere with the back and forth movement of the arm as the contest progresses.

It is thus apparent that the objects of the present invention have been accomplished by the provision of the apparatus described above and in a convenient, straightforward, and low cost manner which additionally enhances the enjoyment of arm wrestling matches by the elimination of unfair techniques.

While there is shown and described herein certain specific structure embodying this invention, it will be manifest to those skilled in the art that various modifications and rearrangements ments of the parts may be made without departing from the spirit and scope of the underlying inventive concept and that the same is not limited to the particular forms herein shown and described except insofar as indicated by the scope of the appended claims.

What is claimed is:

1. Apparatus for conducting arm wrestling contest between a pair of opposed contestants comprising a frame adapted for upright positioning on a contest surface and defining an arcuately-shaped track, an elongated lever arm having upper and lower ends, said lever arm pivotally supported at its lower end proximate said contest surface and engaged in said track at its upper end for side-to-side arcuate movement within the limits defined by said frame, said arm including a pair of laterally spaced hand grip portions positioned along the extent of said arm intermediate the ends thereof, signal means including activation means positioned on said frame at the opposite ends of said track for contact by said arm when moved to either of its side-to-side limits for activating said signal means.

2. The apparatus of claim 1, said frame including a pair of laterally spaced, arcuately-shaped members defining said track therebetween.

3. The apparatus of claim 2, said members being semicircular.

4. The apparatus of claim 1, said signal means including a pair of switches positioned at opposite ends of said track for alternate contact by said lever arm and a light, buzzer or the like positioned on said frame and activated upon contact between said lever arm and either of said switches.

5. The apparatus of claim 1, including means for maintaining said lever arm in a generally upright position between the side-to-side limits of said track, said means including a pin adapted to pass through said members and in between said lever arms.

6. The apparatus of claim 1, said lever arm having both upper portions extending into said track.

7. The apparatus of claim 6, said lever arm having a bifurcated upper portion defining said spaced grip portions and further extending upwardly between said members into said track defined thereby.

8. The apparatus of claim 1 in combination with a table and opposed benches which elevate contestants sitting on said benches such that their legs cannot reach the ground or be braced to the table or bench legs or can their inactive arms reach the table corners and the like.

* * * * *